US005088640A

United States Patent [19]

Littlejohn

[11] Patent Number: 5,088,640

[45] Date of Patent: Feb. 18, 1992

[54] RIGID FOUR RADII RIM PAPER PLATE

[75] Inventor: Mark B. Littlejohn, Neenah, Wis.

[73] Assignee: James River Corporation of Virginia, Richmond, Va.

[21] Appl. No.: 755,768

[22] Filed: Sep. 6, 1991

[51] Int. Cl.[5] ..... B65D 1/34

[52] U.S. Cl. ..... 229/2.5 R; 220/657

[58] Field of Search ..... 229/2.5 R; 220/657, 220/659

[56] References Cited

U.S. PATENT DOCUMENTS

| | | | |
|---|---|---|---|
| 1,575,597 | 3/1926 | Bothe | 229/2.5 R |
| 1,748,865 | 2/1930 | Chaplin | 229/2.5 R |
| 2,348,725 | 5/1944 | Chaplin | 229/2.5 R |
| 2,843,496 | 7/1958 | Altenburg et al. | 229/2.5 R |
| 3,099,377 | 7/1963 | Metzler et al. | 229/2.5 R |
| 3,185,371 | 5/1965 | Reifers | 229/2.5 R |
| 3,346,400 | 10/1967 | Roesner | 229/2.5 R |
| 3,401,863 | 9/1968 | Earl | 229/2.5 R |
| 3,684,633 | 8/1972 | Haase | 229/2.5 R |
| 3,715,218 | 2/1973 | Feely | 220/657 |
| 3,720,365 | 3/1973 | Unger | 229/2.5 R |
| 3,761,011 | 9/1973 | Reifers et al. | 229/2.5 R |
| 4,606,496 | 8/1986 | Marx et al. | 229/2.5 R |
| 4,609,140 | 9/1986 | Van Handel et al. | 229/2.5 R |
| 4,623,088 | 11/1986 | Holden | 229/2.5 R |
| 4,721,500 | 1/1988 | Van Handel et al. | 493/152 |
| 4,899,925 | 2/1990 | Bowden et al. | 229/2.5 R |

*Primary Examiner*—Gary E. Elkins

[57] ABSTRACT

A pressed paper includes a planar center having an outer peripheral surface. The planar center forms a bottom for the pressed paper plate. An outwardly projecting side wall includes a first rim portion joined to the outer peripheral surface of the planar center and a second rim portion joined to the first rim portion. A third rim portion is joined to the second rim portion of the outwardly projecting side wall. A fourth rim portion is provided for forming an outer edge for the container. The first rim portion is joined to the peripheral surface of the planar center at an angle having a first predetermined radius. The second rim portion is joined to the first rim portion at an angle having a second predetermined radius. The third rim portion is joined to the second rim portion at an angle having a third predetermined radius. The fourth rim portion is joined to the third rim portion at an angle having a fourth predetermined radius. The first, second, third and fourth radii are selected for enhancing rigidity of the pressed paper plate as compared to a conventional paperboard container made from the same paperboard stock.

7 Claims, 6 Drawing Sheets

RIGID FOUR RADII RIM PAPER PLATE

BACKGROUND OF THE INVENTION

1. Field of the Invention

The present invention is directed to a paper plate wherein the outwardly projecting rim of the container are formed by regions having four distinct radii of critically controlled configuration.

2. Description of Background Art

Fiberboard containers, such as paper plates and trays, are commonly produced either by molding fibers from a pulp slurry into a desired form of the container or by pressing a paperboard blank between forming dies into a desired shape. The molded pulp articles, after drying, are fairly strong and rigid but generally have rough surface characteristics and are not usually coated so that the containers are susceptible to penetration by water, oil and other liquids. Pressed paperboard containers can be decorated and coated with a liquid-proof coating before being stamped by the forming dies into a desired shape. The products may be formed in many different shapes, for example, rectangular or polygonal as well as round and in multi-compartment configurations.

Pressed paperboard containers tend to have a somewhat reduced strength and rigidity as compared to containers made by a pulp molding process. Much of the strength and resistance to bending of a plate-like container made by either process lies in the sidewall and rim areas which surround the center or bottom portion of the container. In a plate-like structure made by a pulp molding process, the sidewall and overturned rim of the plate are unitary, cohesive structures which have good resistance to bending as long as they are not damaged or split. In contradistinction thereto, when a container is made by pressing a paperboard blank, a flat blank must be distorted and changed in area in order to form the blank into the desired three-dimensional shape. Score lines are sometimes placed around the periphery of the blanks being formed into deep pressed products to allow the paperboard to form or yield at the score lines to accommodate the reduction in area that takes place during pressing. However, the provision of score lines, flutes or corrugations in the blank may result in a formed product with natural fault lines about which the product will bend more readily, under less force, than if the product were unflawed. Shallow containers, such as paper plates, may also be formed from paperboard blanks which are not scored or fluted. However, the pressing operation will cause wrinkles or folds to form in the paperboard material at the rim and sidewalls of the container at more or less random positions. The folds act as natural lines of weakness within the container about which bending may occur.

In a common process for pressing paperboard containers from flat blanks, a sheet or web of paperboard is cut to form the blank, circular shape for a plate, and the blank is then pressed firmly between upper and lower dies which have die surfaces conforming to the desired shape of the finished container. The paperboard web stock is usually coated with a liquid-proof material on one surface and may also have decorative designs printed under the coating. The surfaces of the upper and lower dies have typically been machined such that when the dies begin to compress the shaped paperboard blanks between the dies, the die surfaces will be generally spaced uniformly apart over the entire surface area of the formed paperboard. The lower die may be spring mounted to limit the maximum force applied to the paperboard between the dies. If the spacing between the dies is uniform, the force is distributed over the entire area of the paperboard.

SUMMARY OF THE INVENTION

The present invention provides a pressed paper plate having a planar center including an outer peripheral surface. The planar center forms a bottom for the pressed paper plate. An outwardly projecting sidewall includes a first rim portion joined to the outer peripheral surface of the planar center and a second rim portion joined to the first rim portion. The first and second rim portions form a sidewall of the pressed paper plate. A third rim portion is joined to the second rim portion of the outwardly projecting sidewall and a fourth rim portion is provided for forming an outer edge of the container. The first rim portion is joined to the peripheral surface of the planar center at an angle having a first predetermined radius. The second rim portion is joined to the first rim portion at an angle having a second predetermined radius. The third rim portion is joined to the second rim portion at an angle having a third predetermined radius. The fourth rim portion is joined to the third rim portion at an angle having a fourth predetermined radius. The four radii as well as the four included angles are selected for enhancing rigidity of the pressed paper plate as compared to a conventional paperboard container made from the same paperboard stock.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

BRIEF DESCRIPTION OF THE PREFERRED EMBODIMENTS

Figure 1:
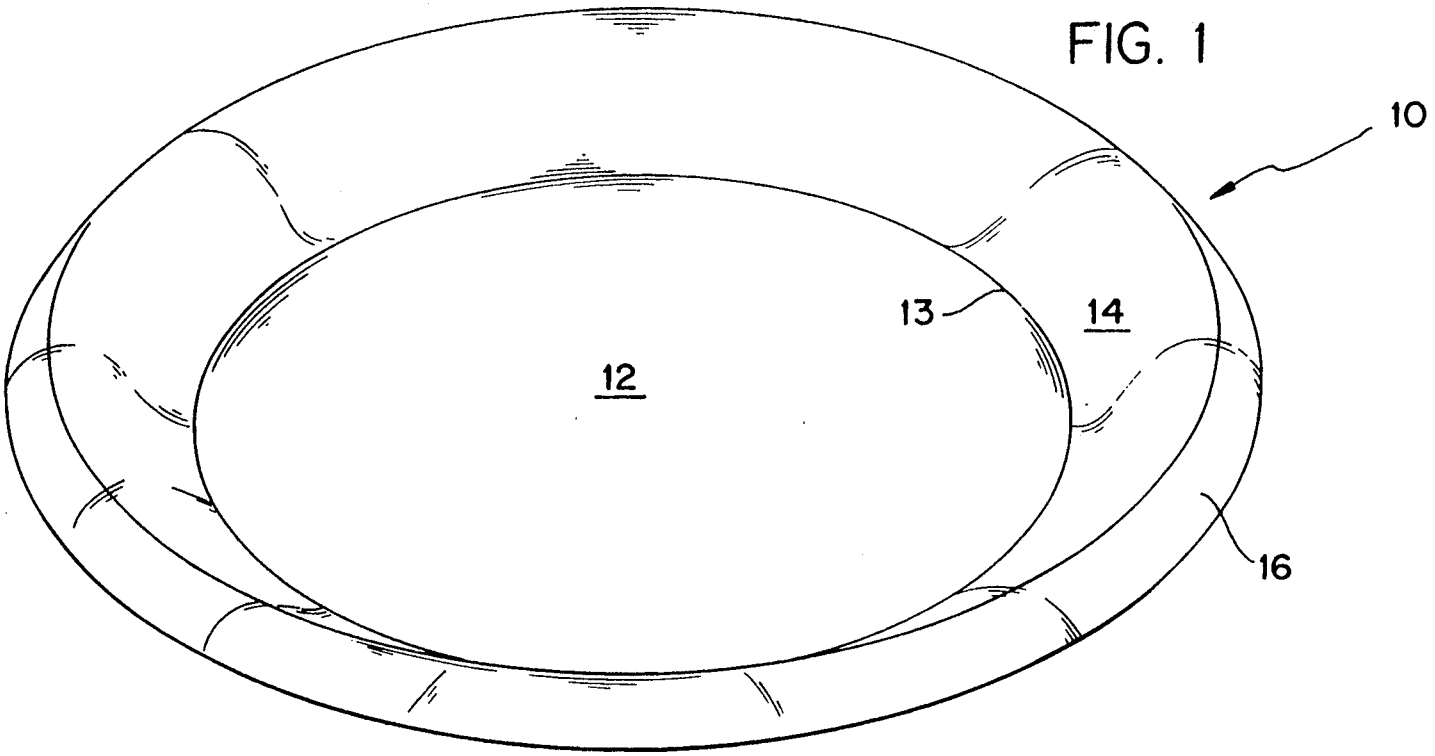
FIG. 1 is a perspective view illustrating a paperboard container having a sidewall and rim configuration made of four radii according to the present invention.
Figure 2:
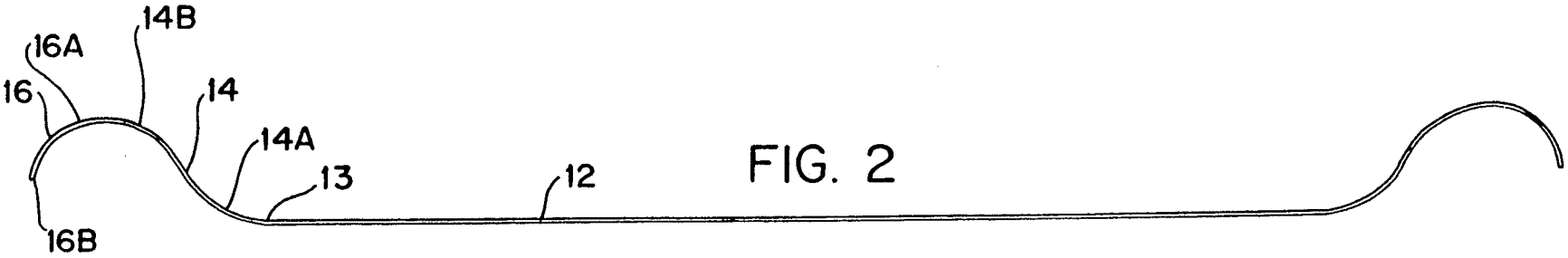
FIG. 2 is a cross-sectional view of the paperboard container illustrated in FIG. 1.

As illustrated in FIGS. 1-4, a pressed paper plate 10 includes a planar center 12 which includes an outer peripheral surface 13. The planar center 12 forms a bottom for the pressed paper plate 10. An outwardly projecting sidewall 14 includes a first rim portion 14A which is joined to the outer peripheral surface 13 of the planar center 12. A second rim portion 14B is joined to the first rim portion 14A. The first rim portion 14A and the second rim portion 14B form the outwardly projecting sidewall 14 which forms the sidewall of the pressed paper plate 10. A rim 16 includes a third rim portion 16A which is joined to the second rim portion 14B of the outwardly projecting sidewall 14. A fourth rim portion 16B is joined to the third rim portion 16A. The fourth rim portion 16B forms the outer edge of the pressed paper plate 10.

Figure 3:
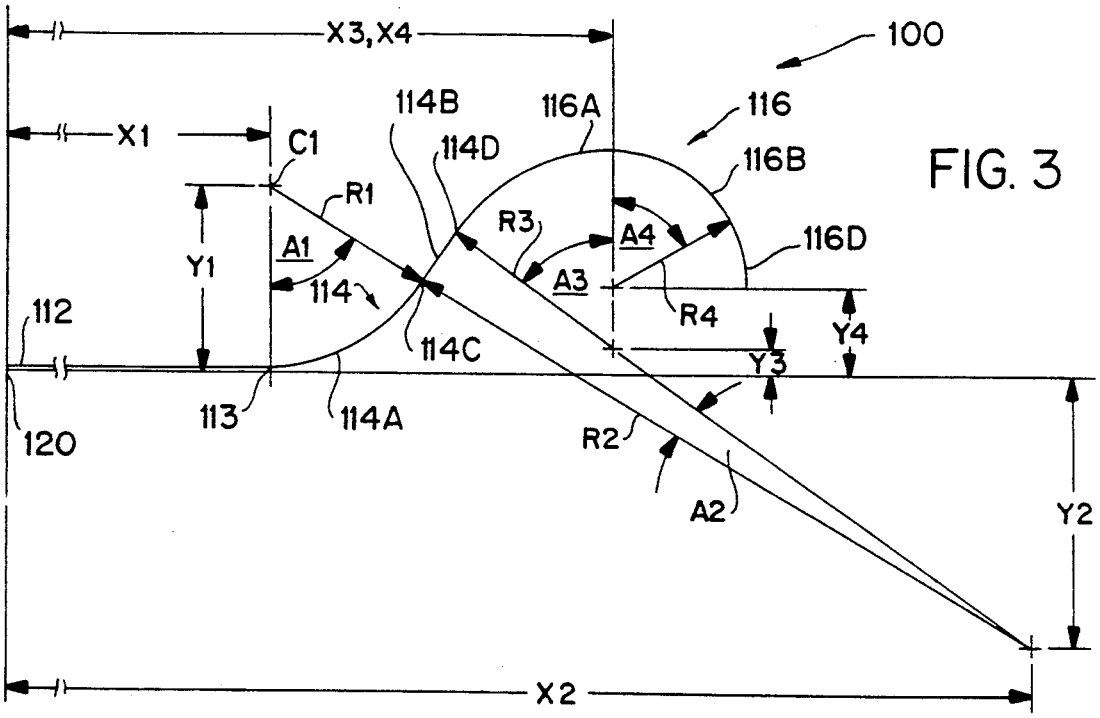
FIG. 3 is a partial cross-sectional view shown in twice the scale of a punch profile utilized in forming the paperboard container of the present invention.

FIG. 3 illustrates a partial cross-sectional view shown in twice the scale of a punch 100 utilized in forming a pressed paper plate of the present invention. The punch 100 includes a center line 120. A base or bottom forming member 112 extends in a substantially horizontal plane to conform with the shape of the planar center for the pressed paper plate. A first rim portion 114A of an outwardly projecting sidewall forming member 114 extends a distance X1 from the center line 120 of the pressed paper plate to the outer peripheral surface 113. A distance Y1 extends from the base or bottom-forming wall 112 upwardly to define an intersection point between the distance X1 and Y1 which is the center point for forming the first arc A1 at a radius R1 from the center point C1. The radius R1 extends a predetermined distance from the center point C1 to extend the distance of the arc A1 from the portion which will define the outer peripheral surface 113 of the pressed paper plate. The arc A1 may be approximately 60°.

A distance X2 is formed from the center line 120 of the pressed paper plate to extend outwardly a predetermined distance. A distance Y2 defines the distance between the surface of the punch 112 extending downwardly a predetermined distance. A second radius R2 extends from the intersection of the lines X2 and Y2 a predetermined distance. A second rim portion 114B of the sidewall-forming portion 114 extends a predetermined arc A2 from a fixed point 114C formed by the end of the arc A1 forming the first rim portion 114A of the sidewall 114. The radius R2 extends through the arc A2 to form the second rim portion 114B and terminates at a second fixed point 114D. The arc A2 may be in the range of approximately 4°.

A distance X3 extends from the center line 120 to a predetermined distance therefrom. A distance Y3 is formed from the plane of the punch 112 to project upwardly a predetermined distance. A radius R3 extends from the intersection of the lines X3 and Y3 to form the third rim portion 116A of the rim 116. An arc A3 is formed between the second fixed point 114D to extend a predetermined distance to a third fixed point 116C. The arc A3 extends a predetermined distance to form the first rim portion 116A of the rim 116. The arc A4 may be approximately 55°.

A distance X4 is equal to the distance X3 and extends a predetermined distance from the center line 120. A distance Y4 is formed to extend a predetermined distance from the base or bottom-forming member 112 of the punch 100. A radius R4 extends from the intersection of the lines X4 and Y4. The radius X4 curves through an arc A4 to form the second rim portion 116B of the rim 116. The arc A4 extends from the third fixed point 116C a predetermined distance defined by the length of the arc A4. The arc A4 may be approximately 60°.

A portion 116D of the arc 116 is formed to extend downwardly from the second rim portion 116B. The portion 116D is utilized to form the edge of the paperboard container.

Figure 4:
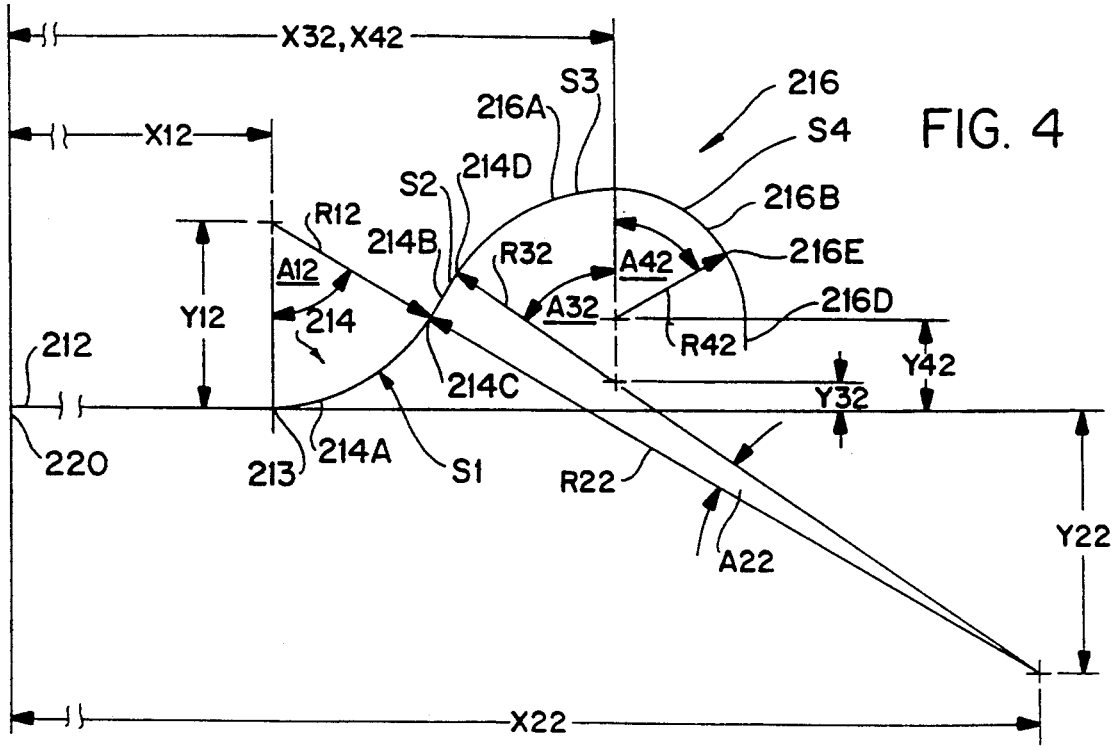
FIG. 4 is a partial cross-sectional view shown in twice the scale of a die profile utilized in forming the paperboard container according to the present invention.

FIG. 4 illustrates a partial cross-sectional view shown in twice the scale of a die 200 utilized in making a paperboard container according to the present invention The die 200 includes a center line 220. A base or bottom-forming portion 212 extends from the center line 220 to an outer peripheral surface 213.

From the center line 220 a predetermined distance X12 extends toward the outer peripheral surface-forming portion 213. A distance Y12 extends a predetermined distance from the base or bottom-forming portion 212 upwardly therefrom. A radius R12 extends from the intersection point of the distance X12 and Y12 to form a first rim portion 214A of the outwardly projecting sidewall 214. The first rim portion 214A is defined by an arc A12 which extends from the vertical line defined at the outer peripheral surface 212 to a fixed point 214C. The arc A12 may be approximately 60°.

A distance X2 extends from the center line 220 to a predetermined point. A distance Y2 extends from the base or bottom-forming portion 212 of the die 200 downwardly a predetermined distance. A radius R22 extends from the intersection of the lines X22 and Y22 to form a second rim portion 214B of the sidewall 214. The radius R2 extends from the first fixed point 214C to the second fixed point 214D through an arc A22. The arc A22 may be approximately 4°.

A distance X32 extends from the center line to 220 a predetermined distance. A distance Y32 extends from the base or bottom-forming section 212 of the die 200 to project upwardly a predetermined distance. A radius R32 extends from the intersection of the lines X32 and Y32 to form the third rim portion 216A of the rim 216. The radius R32 extends from the second fixed point 214D to a third fixed point 216C. An arc A32 is formed between the second fixed point 214D and the third fixed point 216C to extend a predetermined distance. The arc A32 may be approximately 55°.

A distance X42 extends a predetermined distance from the center line 220. Similarly, a distance Y42 extends from the base or bottom-forming section 212 of the die 200 to project outwardly. A radius R42 extends from the intersection of the lines X42 and Y42 to form a fourth rim portion 216B of the rim 216. An arc A42 is formed between the third fixed point 216C and a fourth fixed point 216E. The arc A42 may be approximately 60°. A section 216D forms the outer edge of the paperboard container.

Figure 5:
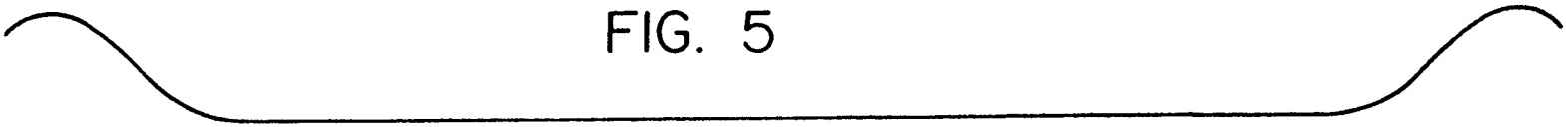
FIG. 5 is a cross sectional view of a paper plate sold under the trademark "LIVINGWARE;"
Figure 6:
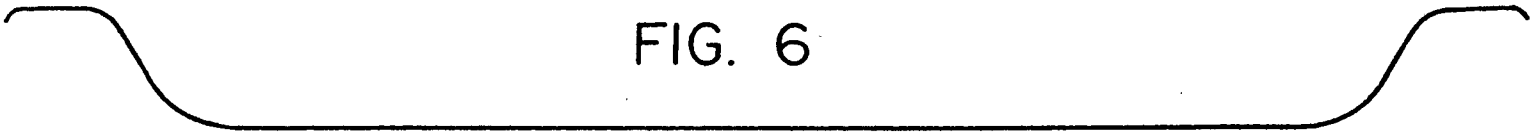
FIG. 6 is a cross-sectional view of a paper plate sold under the trademark "SUPERWARE;"
Figure 7:
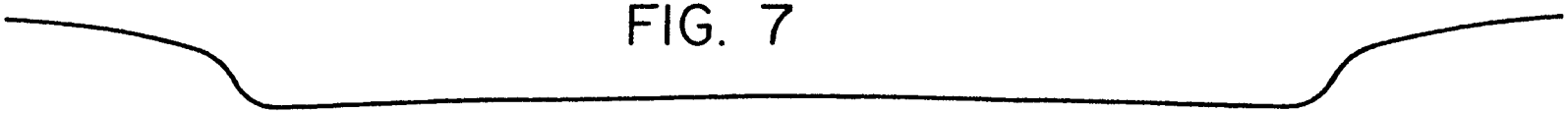
FIG. 7 is a cross-sectional view of a paper plate according to the profile set forth in U.S. Pat. No. 1,575,597.

FIGS. 5, 6 and 7 show cross-sectional views of paperboard containers made according to conventional techniques. FIG. 5 illustrates a cross-sectional view of the container sold under the trademark "LIVINGWARE." This container includes a bottom wall 312 with an outer peripheral edge 313. The sidewall 314 extends upward)y at a predetermined angle from the outer peripheral edge 313. The rim 316 is curved to project outwardly. The sidewall 314 and the rim 316 are formed to provide a certain rigidity to the "LIVINGWARE" container.

FIG. 6 illustrates a cross-sectional view of a container sold under the trademark "SUPERWARE. " This container includes a base or bottom member 412 with an outer peripheral edge 413. A sidewall 414 extends upwardly from the outer peripheral edge 413. A rim 416 is connected to the sidewall 414 and extends outwardly. The sidewall 414 and the rim 416 are formed to add a certain rigidity to the "SUPERWARE" container.

FIG. 7 illustrates a cross-sectional view of a container according to the subject matter set forth in U.S. Pat. No. 1,575,597. This container includes a base or bottom member 512 with an outer peripheral edge 513. A sidewall 514 extends upwardly from the outer peripheral edge 513. A rim 516 is formed to be connected to the sidewall 514. The sidewall 514 and the rim 516 extend at approximately an angle of 10.25° relative to the base or bottom member 512. The sidewall 514 and the rim 516 are designed to add a rigidity to the container according to U.S. Pat. No. 1,575,597.

Figure 8:
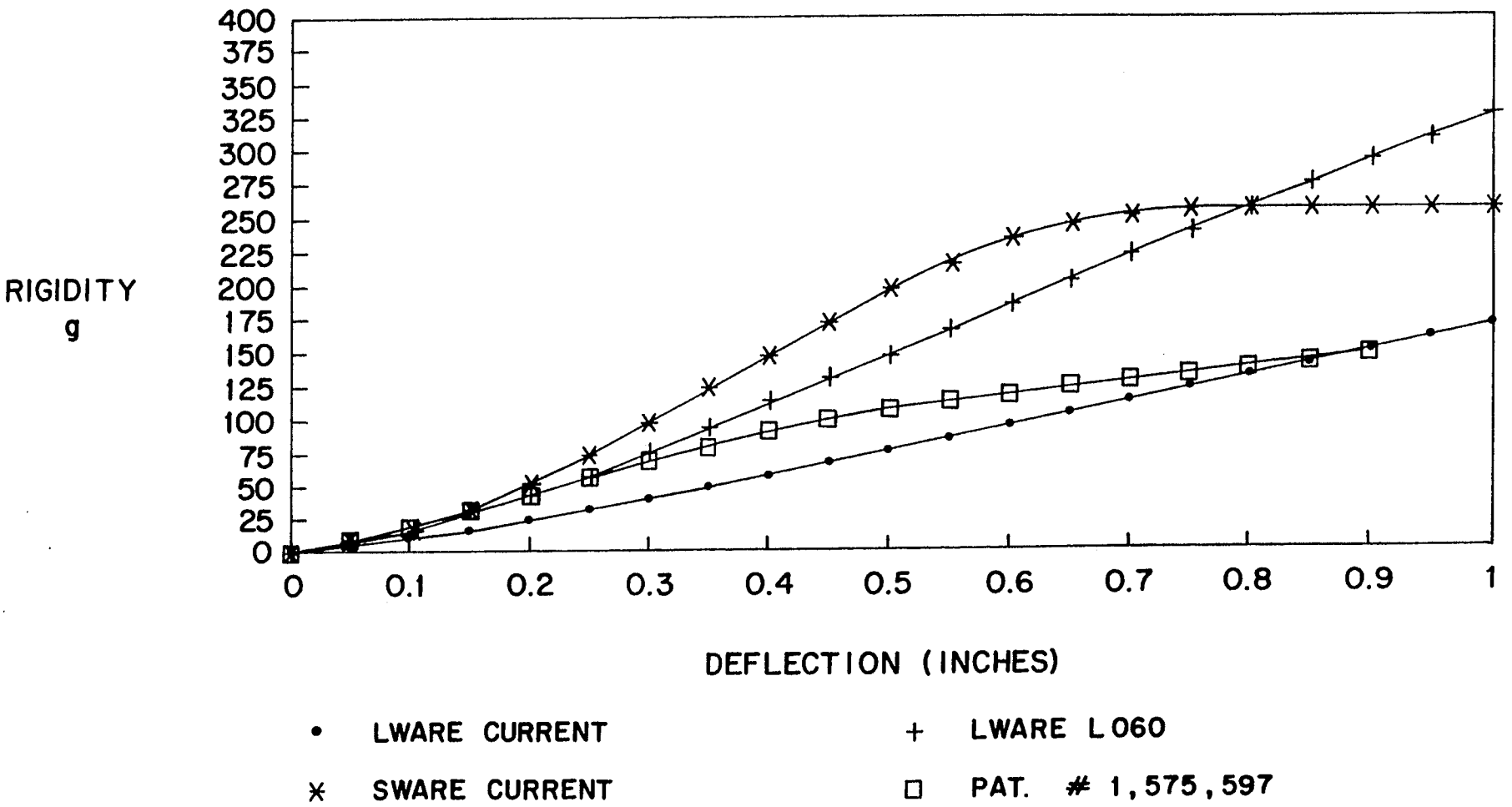
FIG. 8 is a graph illustrating the rigidity as compared to the deflection of the paper plates illustrated in FIGS. 2, 5, 6 and 7 for a fifteen mil caliper paper plate.

FIG. 8 is a graph illustrating the rigidity versus deflection of four containers made from a material having 15 mil caliper. The deflection is illustrated on the X axis. The rigidity is set forth in pounds on the Y axis. The paperboard container according to the present invention indicates that for a deflection of the rim of the container a predetermined distance a certain amount of force in pounds is required. The paperboard container according to the present invention outperforms the "LIVINGWARE" container and the container according to U.S. Pat. No. 1,575,597 for all deflections and loads required to generate the deflection. The paperboard container of the present invention out- performs the "SUPERWARE" container at a load of approximately 255 pounds and a deflection of approximately 2.0 cm or 0.80 inches.

Figure 9:
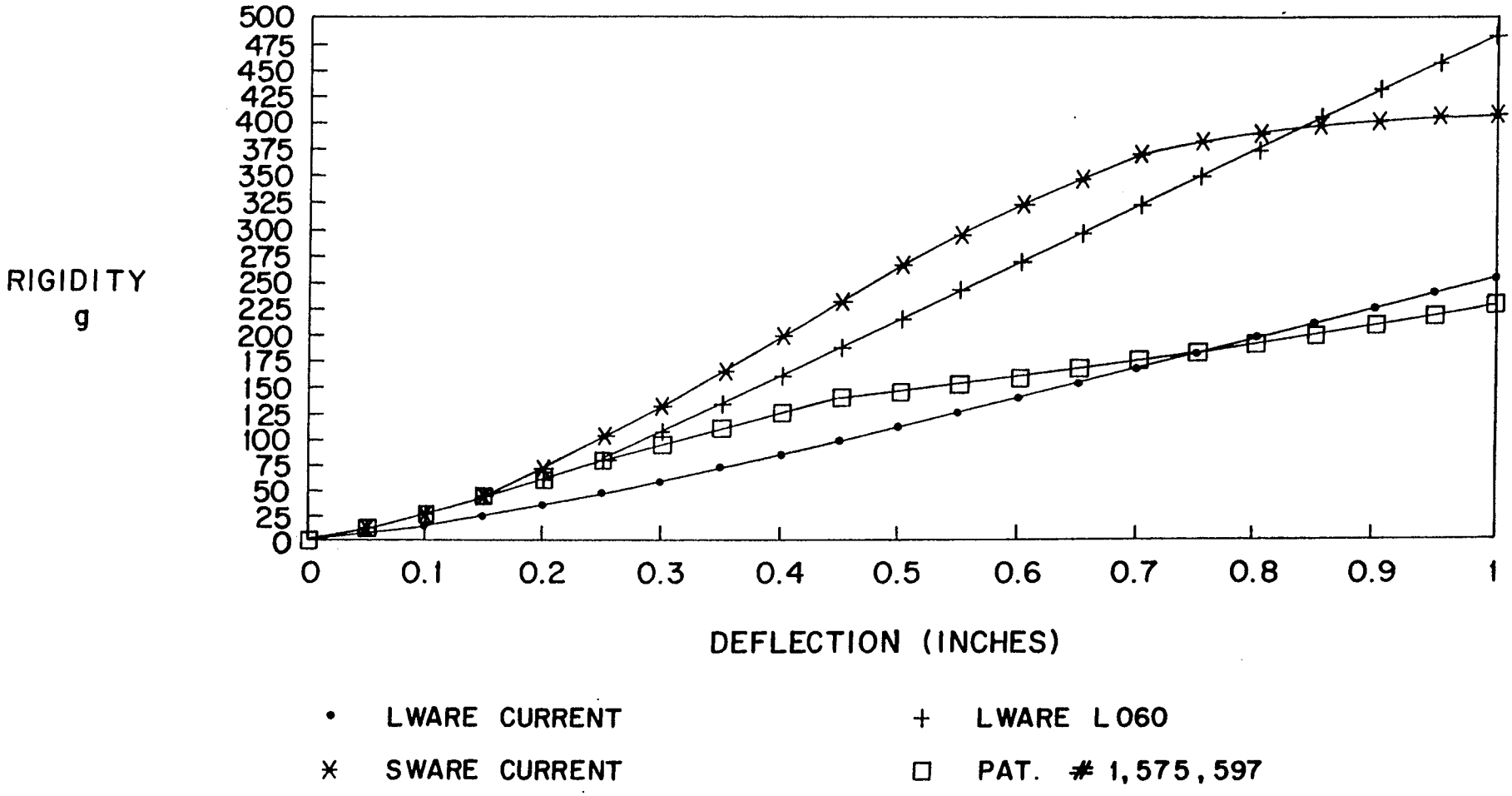
FIG. 9 is a graph illustrating the rigidity versus the deflection of the paper plates illustrated in FIGS. 2, 5, 6 and 7 for a 18.2 mil caliper paper plate.

FIG. 9 illustrates a comparison of rigidity versus deflection for paperboard containers made with 18.2 mil caliper. The paperboard container of the present invention outperforms the "LIVINGWARE" container and the container according to U.S. Pat. No. 1,575,597 for all loads and all deflections. The container according to the present invention outperforms the "SUPERWARE" container for having better rigidity and deflection at a load of approximately 400 pounds and a deflection of approximately 2.1 cm or 0.83 inches.

Figure 10:
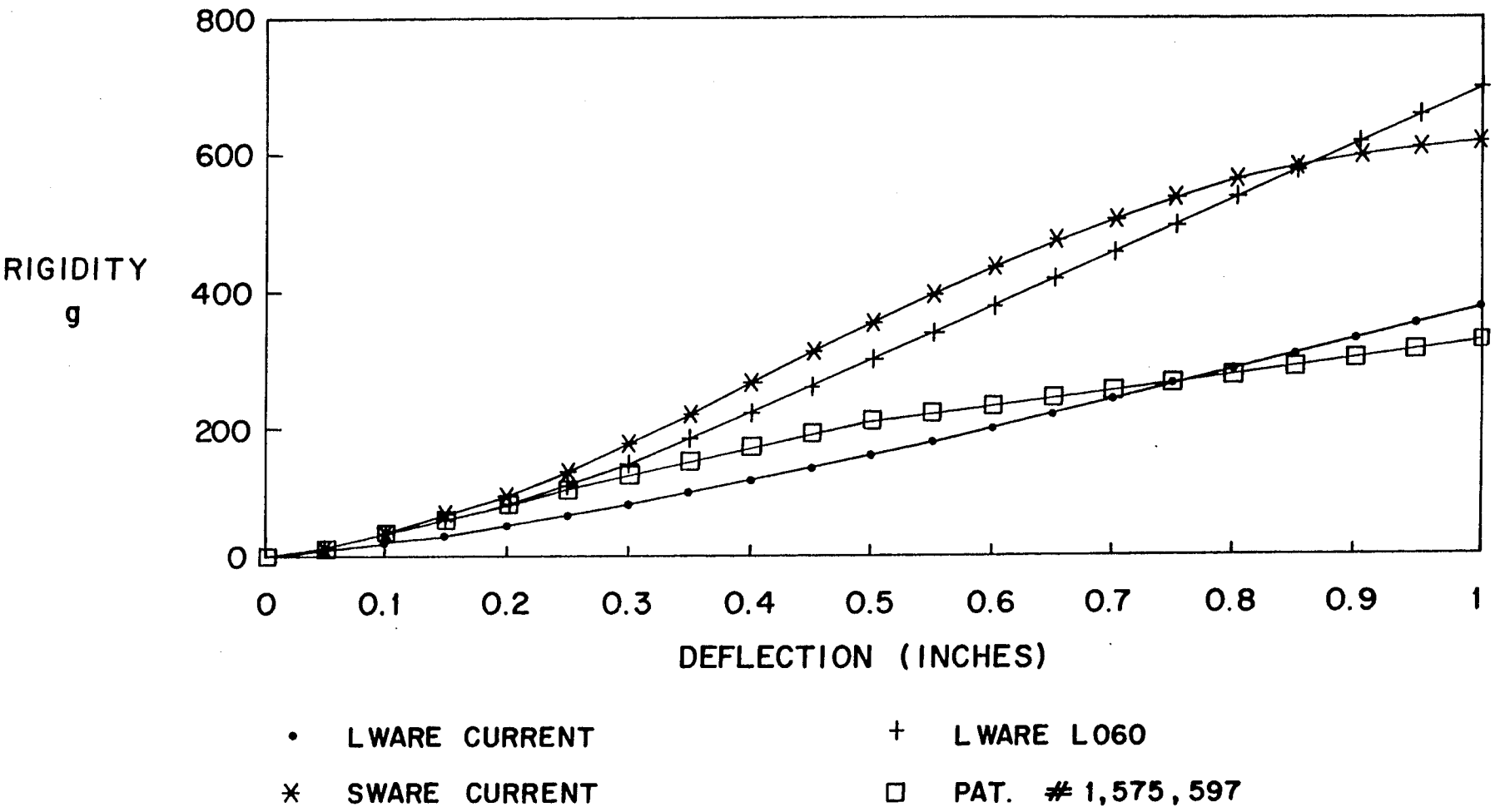
FIG. 10 is a graph illustrating the rigidity as compared to the deflection for the paper plates illustrated in FIGS. 2, 5, 6 and 7 for a 22 mil caliper paper plate.

The graph illustrated in FIG. 10 illustrates the load versus deflection of a rim of a paperboard container made of 22 mil caliper material. The paperboard container according to the present invention outperforms the "LIVINGWARE" container and the container according to U.S. Pat. No. 1,575,597 for all loads and all deflections. The container according to the present invention outperforms the "SUPERWARE" container at a load of 600 pounds and a deflection of approximately 2.1 cm or 0.83 inches.

According to the information illustrated in FIGS. 8–10, the graphs demonstrate that a container made according to the present invention of a certain caliper material, identified as "LWARE L060," will include a rim and sidewall which do not deflect as much under an increased load as compared to the "LIVINGWARE" container, identified as "LWARE CURRENT," and the container according to U.S. Pat. No. 1,575,597. The container according to the present invention performs very well as compared to the "SUPERWARE" container, identified as "SWARE CURRENT." At higher loads, the container according to the present invention outperforms the container sold as a "SUPERWARE" container.

As illustrated in FIGS. 8–10, deflection of a pressed paper plate according to the present invention increases in a fairly straight-line fashion. In contradistinction thereto, the "SUPERWARE" container exhibits large increases in deflection for a very small increase in load. This phenomenon is especially true with loads in the neighborhood of 600 grams which can cause the "SUPERWARE" container to collapse, buckle or dump its contents on a user or on the ground.

The data set forth in FIGS. 8–10 was obtained by using a reference modulus for purposes of comparing the containers built according to different designs. Actual plates may not exhibit the same magnitude of deflection at a given load. However, the relative performance of the plates will be shown by the curves as set forth in FIGS. 8–10.

The container made according to the present invention may have any particular size as desired by the user so long as the relative profile dimensions are maintained. More specifically, ovals, rectangles with rounded corners and other shapes may be made having this profile. In one embodiment of the present invention the container may be a 22.86 cm or 9-inch plate profile made with a die and punch profile coordinates as illustrated in FIGS. 3 and 4 having the following dimensions:

| DIE | | PUNCH | |
|---|---|---|---|
| Inches | Centimeters | Inches | Centimeters |
| R12 = 0.5218 | 1.325 | R1 = 0.5129 | 1.303 |
| X12 = 3.0690 | 7.795 | X1 = 3.0690 | 7.795 |
| Y12 = 0.5218 | 1.323 | Y1 = 0.5299 | 1.346 |
| R22 = 2.0000 | 5.08 | R2 = 2.0218 | 5.135 |
| X22 = 5.2529 | 13.342 | X2 = 5.2529 | 13.342 |
| Y22 = −.7391 | 1.877 | Y2 = −.7566 | 1.922 |
| R32 = 0.5482 | 1.392 | R3 = 0.5613 | 1.426 |
| X32 = 4.0521 | 10.292 | X3 = 4.0521 | 10.292 |
| Y32 = 0.0768 | 0.195 | Y3 = 0.0747 | 0.190 |
| R42 = 0.3741 | 0.950 | R4 = 0.3877 | 0.985 |
| X42 = 4.0521 | 10.292 | X4 = 4.0521 | 10.292 |
| Y42 = 0.2509 | 0.637 | Y4 = 0.2483 | 0.631 |
| A12 = 60° | | A1 = 59.4997° | |
| A22 = 4.1943° | | A2 = 4.1914° | |
| A32 = 55.8057° | | A3 = 55.3083° | |
| A42 = 60.0000° | | A4 = 59.6808° | |
| | | S1 = 0.5326 | |
| | | S2 = 0.1479 | |
| | | S3 = 0.5418 | |
| | | S4 = 0.4038 | |
| | | where $S = R \times A \times \left(\frac{\pi}{180}\right)$ | |

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A pressed paper plate having a substantially planar center section;

a first rim portion outward from and joined to said substantially planar center section, said first rim portion being convex upward, subtending an arc of A1, having a radius of curvature of R1;

a second rim portion outward from and joined to said first rim portion, said second rim portion being convex downward, subtending an arc of A2, having a radius of curvature of R2;

a third rim portion outward from and joined to said second rim portion, said second rim portion being convex downward, subtending an arc of A3, having a radius of curvature of R3, and having a tangent which is substantially parallel to the plane of said substantially planar center section, and a fourth rim portion outward from and joined to said third rim portion, said fourth rim portion being convex downward, subtending an arc of A4, having a radius of curvature of R4; wherein the length of the arc S2 of said second rim portion is substantially less than the length of the arc S4 of said fourth rim portion which in turn is less than the length of arc S1 of said first rim portion and wherein the radius of curvature R4 of said fourth rim portion is less than the radius of curvature R3 of said third rim portion which is less than the radius of curvature R2 of said first rim portion; and wherein the tangents of each of said rim portions at its point of intersection with each adjoining rim portion is substantially equal to the tangent of said adjoining rim portion at the point of intersection and wherein the angle subtended by arc A1 exceeds 55° and the angle subtended by arc A3 exceeds 45°.

2. The pressed paper plate of claim 1, wherein the length of arc S1 is substantially equivalent to the length of arc S3 and the radius of curvature R1 is substantially equivalent to R3.

3. The pressed paper plate of claim 1, wherein the height of the center of curvature of said first rim portion above the plane of said substantially planar center section is substantially equal to the distance by which the center of curvature of said second rim portion is below the plane of said substantially planar center section.

4. The pressed paper plate of claim 1 wherein the horizontal displacement of the center of curvature of said second rim portion from the center of curvature of said first rim portion is at least about twice the radius of curvature of said first rim portion.

5. The pressed paper plate of claim 1, wherein the height of the center of curvature of said third rim portion above the plane of said substantially planar center section is less than the height of the center of curvature of said fourth rim portion above the plane of said substantially planar center section.

6. The pressed paper plate of claim 1, wherein the horizontal displacement of the center of curvature of said second rim portion is located outwardly from the center of curvature of both said third and fourth rim portions.

7. The pressed paper plate of claim 1, wherein the height of the center of curvature of said third rim portion above the plane of said substantially planar center section is less than about 0.75 times the radius of curvature of said fourth rim portion and the height of the center of curvature of said fourth rim portion above the plane of said substantially planar center section is at least about 0.4 times the radius of curvature of said first rim portion plane of said substantially planar center section is substantially equal to the distance by which the center of curvature of said second rim portion is below the plane of said substantially planar center section.

* * * * *

UNITED STATES PATENT AND TRADEMARK OFFICE

CERTIFICATE OF CORRECTION

PATENT NO. : 5,088,640

DATED : February 18, 1992

INVENTOR(S) : Mark B. Littlejohn

It is certified that error appears in the above-identified patent and that said Letters Patent is hereby corrected as shown below:

Column 3, line 60, delete "116C"

Column 4, line 4, delete "116C"
line 44, delete "216C"
line 46, delete "216C"
line 54, delete "216C"
line 64, change "ward)y" to -- wardly --

Column 7, Claim 1, line 6, change "said second rim portion being" to -- said third rim portion being --

Column 8, Claim 7, line 30, change "rim portion plane" to -- rim portion and wherein the height of the center of curvature of said first rim portion above the plane --

Signed and Sealed this

Fifth Day of October, 1993

*Attest:*

Bruce Lehman

BRUCE LEHMAN

*Attesting Officer*

*Commissioner of Patents and Trademarks*